US007743536B2

(12) United States Patent
Evans et al.

(10) Patent No.: US 7,743,536 B2
(45) Date of Patent: Jun. 29, 2010

(54) HINGED PLOW AND SCRAPER BLADE

(75) Inventors: Miles M. E. Evans, Regina (CA); Donald Stevenson, Raymore (CA)

(73) Assignee: Degelman Industries Ltd., Regina Saskatchewan (CA)

( * ) Notice: Subject to any disclaimer, the term of this patent is extended or adjusted under 35 U.S.C. 154(b) by 0 days.

(21) Appl. No.: 11/693,078

(22) Filed: Mar. 29, 2007

(65) Prior Publication Data

US 2008/0235996 A1 Oct. 2, 2008

(51) Int. Cl.
*E01H 5/06* (2006.01)

(52) U.S. Cl. ..... 37/274; 37/232; 37/281; 37/231; 172/811; 172/273

(58) Field of Classification Search ..... 37/231, 37/273, 274, 280, 281, 232; 172/272, 273, 172/701.1, 811, 816
See application file for complete search history.

(56) References Cited

U.S. PATENT DOCUMENTS

| | | | | | |
|---|---|---|---|---|---|
| 2,754,601 | A | * | 7/1956 | Meyer | 37/231 |
| 3,233,350 | A | * | 2/1966 | Malzahn et al. | 172/273 |
| 4,255,878 | A | * | 3/1981 | Mahler et al. | 37/232 |
| 4,479,312 | A | | 10/1984 | Turgeon | |
| 4,794,710 | A | | 1/1989 | Haring | |
| 5,191,729 | A | | 3/1993 | Verseef | |
| 5,251,390 | A | * | 10/1993 | Wong | 37/231 |
| 5,285,588 | A | | 2/1994 | Niemela et al. | |
| 5,437,113 | A | | 8/1995 | Jones | |
| 5,638,618 | A | | 6/1997 | Niemela et al. | |
| 5,697,172 | A | | 12/1997 | Verseef | |
| 5,758,728 | A | | 6/1998 | Ragule | |
| 5,829,174 | A | * | 11/1998 | Hadler et al. | 37/234 |
| 6,035,944 | A | * | 3/2000 | Neuner et al. | 172/818 |
| 6,044,579 | A | | 4/2000 | Hadler et al. | |
| 6,073,371 | A | | 6/2000 | Goos et al. | |
| 6,125,559 | A | | 10/2000 | Mullenhour | |
| 6,442,877 | B1 | * | 9/2002 | Quenzi et al. | 37/281 |
| 6,618,965 | B1 | | 9/2003 | Schultz et al. | |
| 7,107,709 | B2 | | 9/2006 | Hamel | |
| 2006/0042128 | A1 | | 3/2006 | Schultz et al. | |

OTHER PUBLICATIONS www.tellefsdal.no/hovedside_nor.htm.

* cited by examiner

*Primary Examiner*—Thomas B Will
*Assistant Examiner*—Mai T Nguyen
(74) *Attorney, Agent, or Firm*—Daniels Patent Law PLLC; Scott A. Daniels

(57) ABSTRACT

A materials moving blade (1) comprising a main blade (3) having a materials engaging surface extending bounded by a first end, a second end, a top edge (37) and a lower edge (39) defining a hinge axis, a plurality of trip blades (9) supported at the lower edge (39) of the main blade (3) and a universal mounting panel having a plurality of holes in the mounting panel for accommodating different mounting system geometries.

9 Claims, 12 Drawing Sheets

HINGED PLOW AND SCRAPER BLADE

FIELD OF THE INVENTION

The present invention relates to an improved materials moving blade, for example a snow plow, which includes a pair of hinged or articulating wing blades attached to a main blade. The improved materials moving blade is modular, allowing simple interchangability of components, and includes a plurality of spring biased, scraper blades supported on a lower portion of both the main blade and wing blades. The materials moving blade further includes a universal mounting panel to facilitate attachment of the moving blade to a variety of vehicles.

BACKGROUND OF THE INVENTION

When moving materials with a front-mounted materials moving blade such as a snowplow, a not infrequent occurrence is striking an object, which is concealed beneath the snow. Modern snow removal devices, such as vehicle-mounted, snow throwers and snow plows are generally mounted to the front ends of light, medium and heavy duty trucks, front loaders, backhoes, tractors, graters and similar vehicles. Snowplow blades typically include a curved mold board, which is mounted on a frame. Snow throwers and plows alike have a wear strip, often made of steel, which may be mounted to the bottom of the frame to act as a scraping blade to remove snow from the ground and to direct snow onto the mold board.

Roads and other plowing surfaces may include a variety of irregularities and obstructions, such as manhole covers, rocks, raised or cracked road situations and debris to become frozen into the ground. Such obstacles may lie partially or completely beneath the surface of the snow and are, therefore, hidden from the operator's view. There is always a risk that the plow blade edge or other portion of the plow will strike such an obstruction while plowing. In addition to such unforseen obstructions, known road features, such as curbs and berms, may be hidden from the plow operator by the snow. There is always a risk, therefore, that the plow operator will miscalculate the distance to such a known road feature and fail to stop the plow before it impacts the hidden road feature.

The plow blade may strike the obstruction with significant force, which is then transferred rearward from the plow blade to the plow assembly, the attached vehicle and the vehicle operator. Such impacts may be significant not only at faster plowing speeds of 25-30 m.p.h., but even at slower speeds of 10-15 m.p.h. The force of such an impact may not only cause a sudden deceleration of the plow and attached vehicle, but may also cause the plow to violently and completely stop the vehicle. In some cases, the plow may deflect off the obstruction and jump into the air. In some other cases, the bolts holding the cutting edge have been known to shear, causing the cutting edge to flip through the air, thereby becoming a dangerous projectile and road hazard. This response to hitting an obstruction may not only cause significant damage to the plow and truck, but also cause personal injury to the plow operator and other nearby vehicles. Although driving at slower speeds may decrease the damage caused by such impact, slower speeds decrease plowing efficiency. Furthermore, driving at slower speeds still does not completely eliminate impacts because, as described above, obstruction may be completely hidden from view and, therefore, be unavoidable even to the most careful operators.

As a result of these problems, various efforts have been made to design plows to minimize the undesirable consequences just described. This is accomplished in one of two different types of blades. In a first known device, a snowplow blade is mounted at a pivot point on a support structure using a pivoting mechanism where the entire snowplow blade pivots when the bottom of the plow blade encounters an obstacle. Upon impact, the bottom of the blade pivots backwards to absorb the impact and the top of the blade correspondingly pivoting forward about the pivot point of the blade. In a second device, a trip blade is hingedly mounted at the bottom of an upper blade and pivots about the hinge when it encounters an obstacle.

Such materials moving blades and snowplow blades having a scraper blade system for scraping snow and ice off a roadway are generally known in the art, for example, from U.S. Pat. No. 7,107,709 to Hamel, which discloses an articulated scraper blade system mounted to a snowplow blade length and installed in front of a vehicle for snow scraping. The blade includes a multitude of carbide sections moving independently when they strike an obstacle in a road surface. By way of another example, many existing snowplow blades are equipped with a blade trip mechanism, also referred to as a "trip edge" or "trip assembly", which allows the bottom of the plow blade to yield ("trip") upon substantial impact.

Conventional trip edges are described, for example, in U.S. Pat. No. 6,618,965, entitled "Method for Absorbing Bi-Directional Impact of Snow Plow Blade Tripping". In general, the plow blade is enabled to trip upon impact by mounting the snowplow blade on its support structure using a pivoting mechanism. The plow blade may, for example, be mounted on the support structure at a height of 8 to 16 inches above the ground. The pivoting mechanism enables the bottom of the snowplow blade to pivot in a rearward direction when the blade impacts an obstruction. The top of the snowplow blade pivots forward as the bottom of the snowplow blade pivots rearward in response to the force imposed by the obstruction. This rearward pivoting of the bottom of the snowplow blade in response to impacting an obstruction is referred to as "tripping".

Typically, one or more strong springs (referred to as "trip springs") are mounted behind the snowplow blade to resist tripping the blade edge except in response to a sufficiently strong rearward force. When the snowplow blade is in its normal (untripped) position, the trip springs are under tension, holding the blade edge in place. When the bottom of the snowplow blade is forced backward by an obstruction, the trip springs provide a resistive force, which tends to absorb at least some of the force of impact with the obstruction. The force of such an impact may be reduced by this energy absorption, but still will impose some deceleration of the plow and attached vehicle. It may also cause the plow to violently lift into the air, sometimes by two feet or more and then rapidly fall, impacting the ground. Then the ripping force imposed by the obstruction is removed, the trip springs provide a restorative force which return the snowplow blade to its normal (untripped) plowing position.

Another issue which arises with such materials moving blades is the tremendous variety of vehicles which are used to support, carry and operate the material moving blades. For example, a particular manufacturer's farm tractor has an entirely different mounting geometry and support structures for a blade than a truck used by a municipal entity for clearing snow on public roads. Both the farm tractor and the truck may use the same blade, but because the geometry and support structure on each of the vehicles is entirely different, the blade for each vehicle must be specifically designed and fabricated.

Therefore, a materials moving blade manufacture expends significant time and expense in modifying the mounting fit-ups and welding on the blades for different vehicles. A manufacturer may also have to produce and stock a significant number of blades with different fit-ups which requires an estimation of demand for a particular vehicle which is difficult and inefficient to foresee. If a customer desires a blade for the farm tractor, and the manufacture has in stock only blades for trucks, the manufacture cannot simply supply one of the in-stock blades. In this case either a new blade must be produced, or an existing in-stock blade must be modified, and either option is inefficient for manufacturing as well as inconvenient for the customer.

Furthermore, a manufacturer generally stocks complete ready to ship blades. In the case of materials moving blades with wings, the wings are attached during the fabrication and production process with the result being a fixed width blade. The manufacturer stores a certain number of these complete blades as inventory. Again, an accurate inventory is difficult to ascertain because of the tremendous variety of vehicles to which such blades must be attached, as well as the desire of a customer for a specific width blade for their materials moving requirements.

OBJECTS AND SUMMARY OF THE INVENTION

It is an object of the present invention to provide a materials moving blade or snowplow, which includes at least one articulating wing section, where the wing blade can be adjusted with respect to the main blade at least to a 90° angle.

It is a further object of the invention to provide a tripping or scraper blade mounted on a lower edge of both the main blade and the at least one wing blade in order to facilitate the passage of the materials moving blade over an obstacle in a surface being plowed.

It is a still further object of the present invention to provide a spring trip, including a biasing return spring, for returning the tripping or scraper blades to a neutral position with respect to the main blade and wing blades.

It is a still further object of the present invention to provide a hydraulic actuator in cooperation with a wing control mechanism for controlling the relative angular adjustment of the wing blade relative to the main blade.

In an even further embodiment of the present invention, the materials moving blade is provided with a universal mounting panel on the back of the blade to facilitate the attachment of different vehicle specific mounting systems to support and control the blade.

Another object of the present invention is to provide a modular materials moving blade system by which different length wing components can be easily interchanged with a main blade component by simple removal of a hinge rod.

It is a yet still further object of the present invention to provide a pair of semi-elliptical hinge panels, one on a front surface of the main blade and another on the wing blade interconnected by a hinge rod so as to define a linear hinge forming the apex of a substantially triangular hinge gusset formed between the main blade and a respective attached wing blade.

In one embodiment of the present invention, a materials moving blade is provided with a main blade and at least a wing blade hinged to the main blade having an articulating mechanism which permits the wing blade to be moved about the hinge between an angle of at least 0° and 90° relative to the main blade.

The present invention relates to a materials moving blade (1) comprising a main blade (3) having a materials engaging panel bounded by a first end, a second end, a top edge (6) and a lower edge (8) having a hinge axis, a plurality of spring biased trip blades (9) supported by the hinge axis along the lower edge (8) of the materials engaging panel, each trip blade (9) supporting a cutting blade, and a rear mounted panel of the main blade comprising an array of holes for receiving a connection to a separate materials moving blade support structure.

The present invention also relates to a method of supporting a materials moving blade (1) comprising the steps of constructing a main blade (3) having a materials engaging panel bounded by a first end, a second end, a top edge (6) and a lower edge (8) having a hinge axis, supporting a plurality of spring biased trip blades (9) on the hinge axis along the lower edge (8) of the main blade (3); and forming an array of holes on a rear mounted panel spaced from the materials engaging panel of the main blade.

BRIEF DESCRIPTION OF THE DRAWINGS

The invention will now be described, by way of example, with reference to the accompanying drawings in which.

DETAILED DESCRIPTION OF THE PREFERRED EMBODIMENTS

Figure 1:
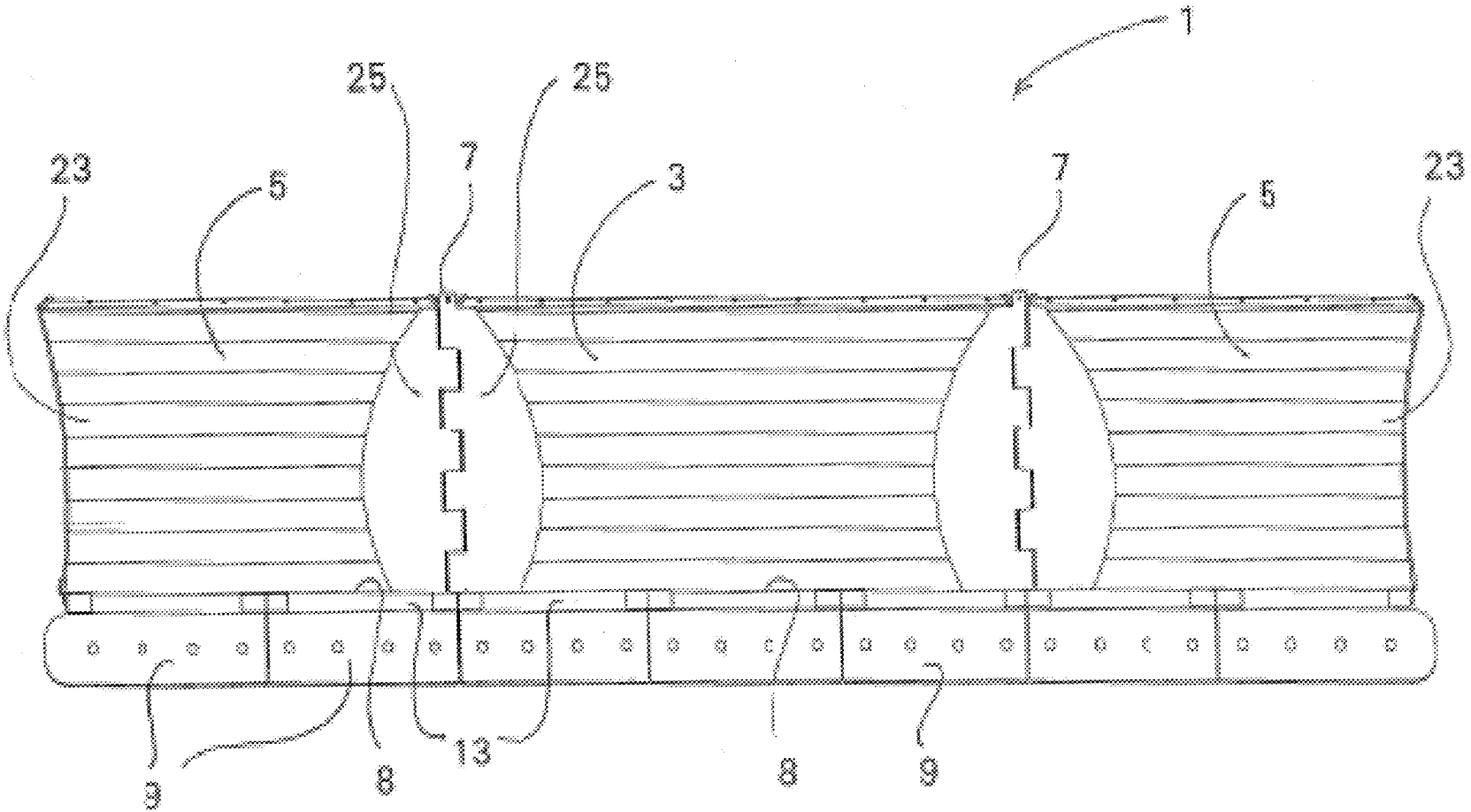
FIG. 1 is a front elevation view of a materials moving blade according to the present invention.

The hinged materials moving blade 1, snowplow and scraper blade, as it is also known, is shown in FIG. 1, including a main blade 3 and a pair of wing blades 5 attached to the opposing left and right sides of the main blade 3. Each of the wing blades 5 are attached to the main blade 3, via a wing hinge 7, interposed therebetween which permits the angulation of the wing blade 5 between at least a 0° and 90° angle relative to the main blade 3. Along respective bottom edges 8 of both the wing blade(s) 5 and the main blade 3 are provided a plurality of trip blades 9 supported on a trip hinge 13 along the bottom edge 8 of the main and wing blades 3, 5. The trip hinge 13 permits each of the trip blades 9 to individually rotate about the trip hinge 13 in response to impacting an obstacle in the road. A rearward release or rotation of these trip blades 9 facilitates the passage of the blade 1 over the obstacle and minimizes damage to the materials moving blade 1. A spring bias provides for the return of the trip blades 9 to an initial operating position.

The main blade 3 comprises a left and right side opposing ends for mating with respective ends of an adjacent attached wing blade 5. The main blade 3 is provided with a front surface 23 which, as is generally known in the art, is curved in a concave manner between a top edge and the bottom edge 8 along a length between the opposing ends of the main blade 3. The bottom edge 8 of the main blade 3 supports the trip hinge 13, as discussed in further detail below, and the left and right side opposing ends of the front surface 23 of the main blade 3 include semi-elliptical panels 25 forming the wing hinges 7.

Figure 2C:
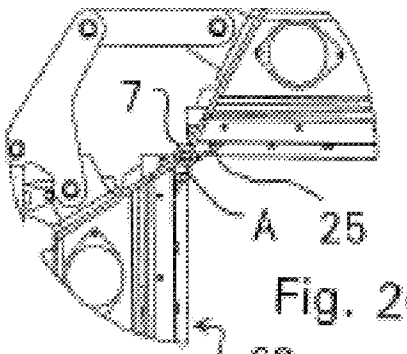
FIG. 2C-D are a rear perspective view and a top plan view of the hinge gusset and and wing actuation mechanism respectively.
Figure 2B:
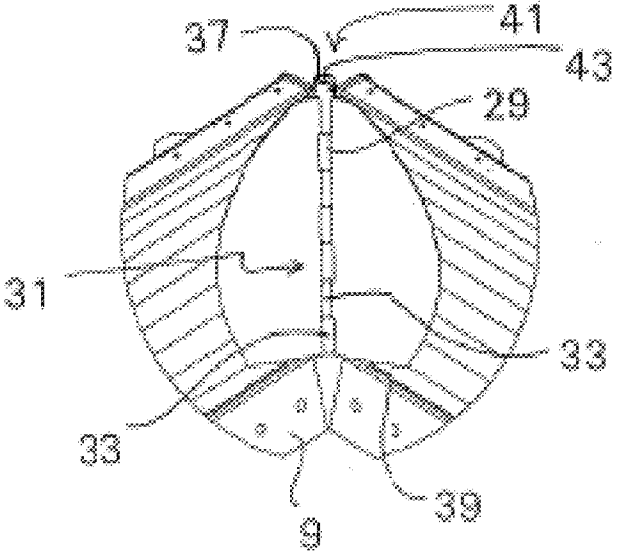
FIGS. 2A-B are front perspective view of the hinge gussets of the materials moving blade.
Figure 2D:
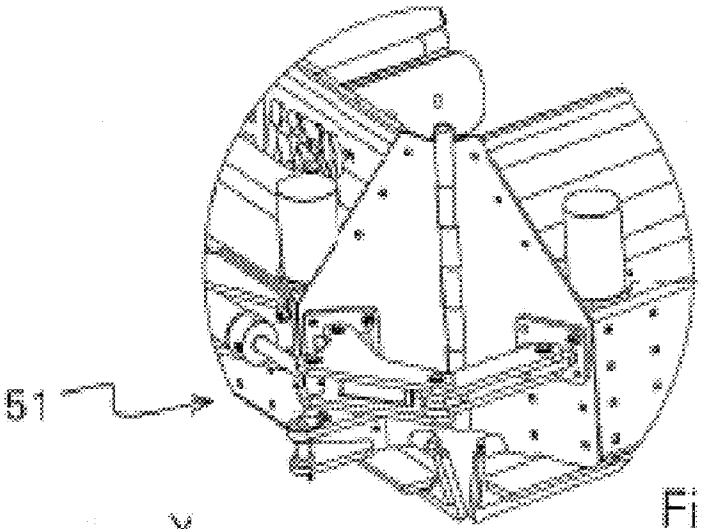
Figure 2A:
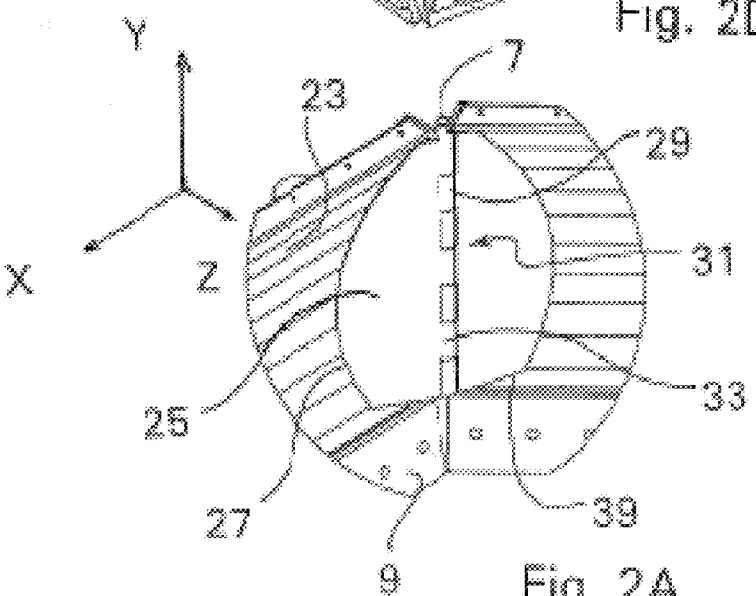

Each panel 25 forms one-half of a substantially triangular gusset for the wing hinges 7. As better shown in FIGS. 2A-C, each panel 25 extends forward and laterally from an elliptical intersection 27 with the concave front surface 23 of the main blade 3. The elliptical, or curved intersection 27 is spaced from the respective end of the main blade 3 and an elliptical edge of the panel 25 is attached to the front surface 23 of the main blade 3 at the intersection 27 usually by way of welding. The elliptical edge of the panel 25 is formed in a manner to match the concave profile of the front surface 23 of the main blade 3. Because the panel 25 extends forwardly and laterally from the front surface 23 of the main blade 3, i.e., creating an acute angle A between the panel 25 and the front surface 23 of the main blade 3, the elliptical edge of the panel 25 must therefore match the profile of the front surface 23 in three (3) dimensions, the x-y-z dimensions as shown in FIG. 2A, and not merely the two-dimensional profile where a gusset is welded perpendicular to the front surface 23 of the main blade 3, as would be defined by the y-z plane, for example.

The panel 25 extends from the elliptical edge (and intersection 27 with the front surface 23) at the acute angle A, relative to the front surface 23 of the main blade 3, to a linear hinge edge 29 spaced forward of the front surface 23. The linear hinge edge 29 is substantially vertically aligned, relative to a surface being plowed, although the specific alignment may change depending on the relative vertical orientation of the main blade 3. The linear hinge edge 29 forms a crenelated hinge section 31 defined by a plurality of spaced apart hinge passages 33, where spaces 35 between the hinge passages 33 are sized to receive a mating hinge passage 33 of a respective mating panel 25. The upper edge 37 of the panel 25 is generally flush with the upper edge 37 of the main blade 3 and a lower edge 39 of the panel 25 is substantially at the same height as the lower edge 39 of the main blade 3 and the trip hinges 13.

A similarly constructed panel 25 is positioned on an inner edge of the wing blade 5 except the crenelated hinge section 31 defined by the hinge passages 33 and adjacent spaces are opposite that of the panel 25 attached to the main blade 3 so as to achieve a matching fit between the mating linear hinge edges 29 where the hinge passages 33 fit into the oppositely disposed spaces of the other hinge edge 29. The vertically adjacent hinge passages 33 of each gusset 25 thus form a hinge bore 41 through which a hinge rod 43 is inserted to hold the linear hinge edges 29 of the opposing panels 25 together and hence attach the wing blade 5 to the main blade 3 and permit it to bend through at least a 90° relative rotation, as shown in FIG. 2D.

Figure 3B:
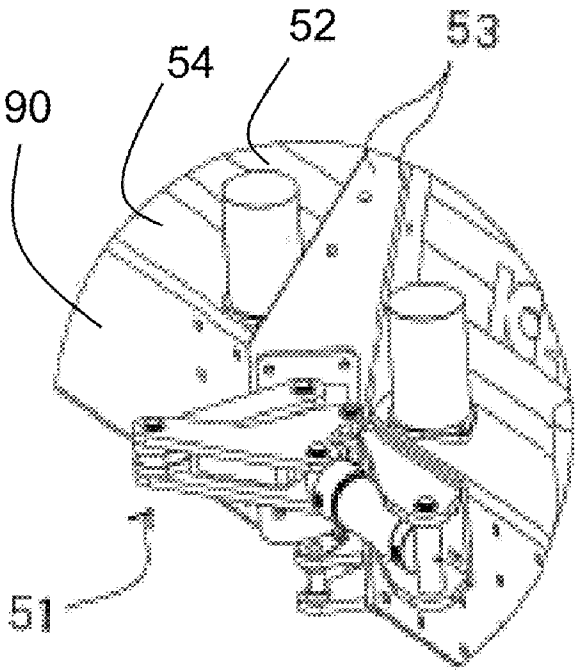
FIG. 3A-B are rear perspective views of the wing blade and hinge in an angled orientation and a straight alignment respectively.
Figure 3A:
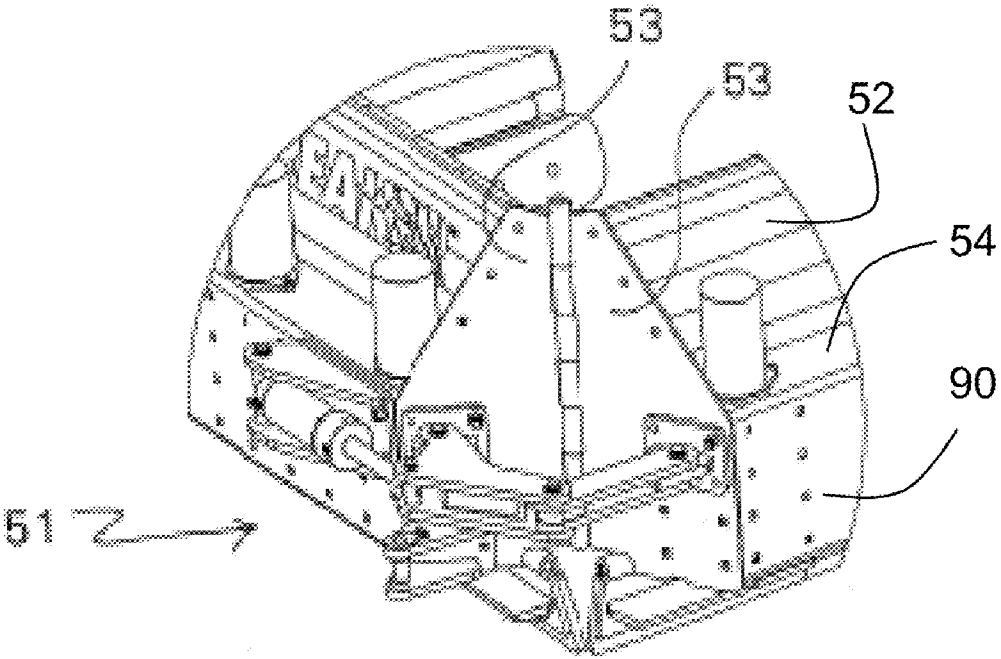
Figure 4:
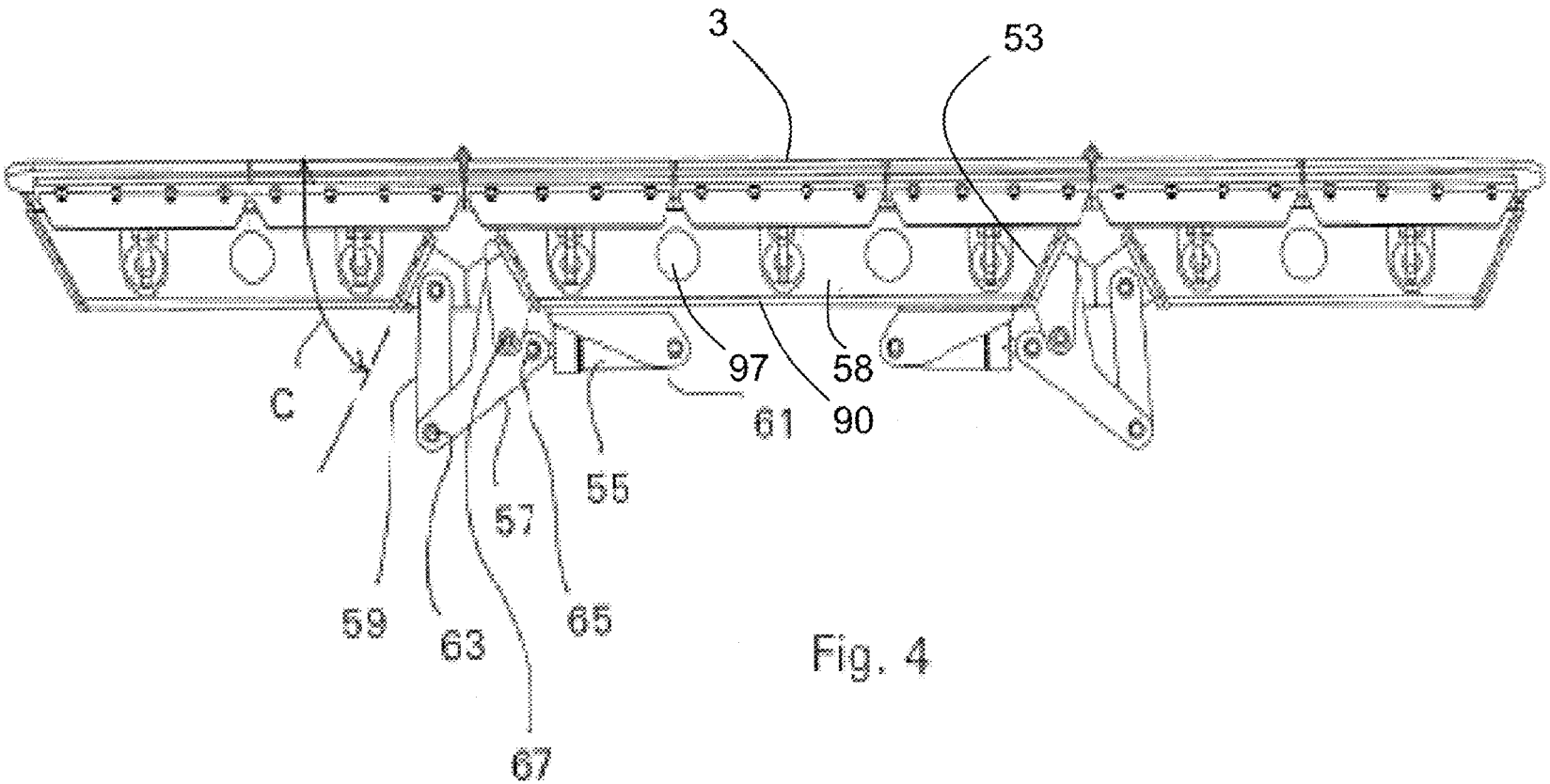
FIG. 4 is a bottom plan view of the materials moving blade in a straight aligned orientation.

Angular control of the wing blade(s) 5, relative to the main blade 3 is accomplished via a wing control mechanism 51 generally positioned on a backside of the main and wing blade 3, 5, as shown in FIGS. 3A-B. At the respective ends where the main blade 3 and the wing blade 5 are joined, both the main blade 3 and the wing blade 5 are constructed with an angled side plate 53. For the moment observing the main blade 3, the angled side plate 53 extends backwards and laterally relative to the front surface 23 so that the side plate 53, is angled at an acute angle C as shown in FIG. 4, relative to the front surface 23 of the main blade 3. In other words, the side plate 53 is not perpendicular to the front surface 23 in the y-z plane, but lies at an acute angle A relative thereto in each of the x-y and z planes.

Similarly, the adjacently attached wing blade 5 has a second angled side plate 53 oppositely disposed from that on the main blade 3 so that the second angled side plate 53 also forms an acute angle C relative to the front surface 23 of the wing blade 5. As can be appreciated by observing FIG. 4, the acute nature of the opposing angled side plates 53 of the main blade 3 and wing blade 5 creates a V-shaped slot between the angled side plate 53 of the main and wing blades 3, 5 when the main and wing blades 3, 5 are in a straight orientation (no relative bend or rotation). This V-shaped slot defines a desired space for the wing control mechanism 51, as described in further detail below, to be attached and actuate the relative rotation between the main and wing blades 3, 5.

Turning to FIG. 4, the wing control mechanism 51 includes a hydraulically actuated piston 55 driving what is essentially a three-bar mechanism, having a first arm 57 pivotally connected to the main blade 3 and to the piston 55, and a second arm 59 pivotally connected between the first arm 57 and the wing blade 3. A base end 61 of the piston 55 is anchored to the back wall 52 of the main blade 3 which is actually a double-walled construction of the main and wing blades. The tripping springs 77 as discussed in further detail below, are sandwiched between the front surface 23 and the back wall 52 of the main and wing blades which permits the hydraulic piston 55 and the wing control mechanism 51 to be unimpeded in its operation of the angulation of the wings 5. More specifically in regards to the wing control mechanism 51, the first arm 57 is pivotally connected with the angled side plate 53 of the main blade 3 and the second arm 59 is pivotally connected with the angled side plate 53 of the wing blade 5. The first and second arms 57, 59 are joined at an intermediate pivot 63 so as to move relative to one another according to control of the piston 55.

The first arm 57 is defined by a triangulated set of three (3) pivot points 63, 65, 67 and is controlled directly by a first pivot point 65 connected to a first end of the piston 55, a second pivot point 67 connects the first arm 57 to the side plate 53 of the main blade 3 and a third pivot point forms the intermediate pivot 63 shared with the second arm 59. The base end of the piston 55 is anchored to a backside of the main blade 3. The second arm 59 is a simple linear bar extending from the intermediate pivot 63 to a pivot connection with the side plate 53 of the wing blade 5. In a retracted state of the piston 55, the wing control mechanism 51 is folded inwards and substantially rearwardly relative to the materials moving blade 1 so as to bring the wing blade 5 into horizontal alignment, i.e., 0° angle with respect to the main blade 3, as shown in FIG. 4.

Figure 5B:
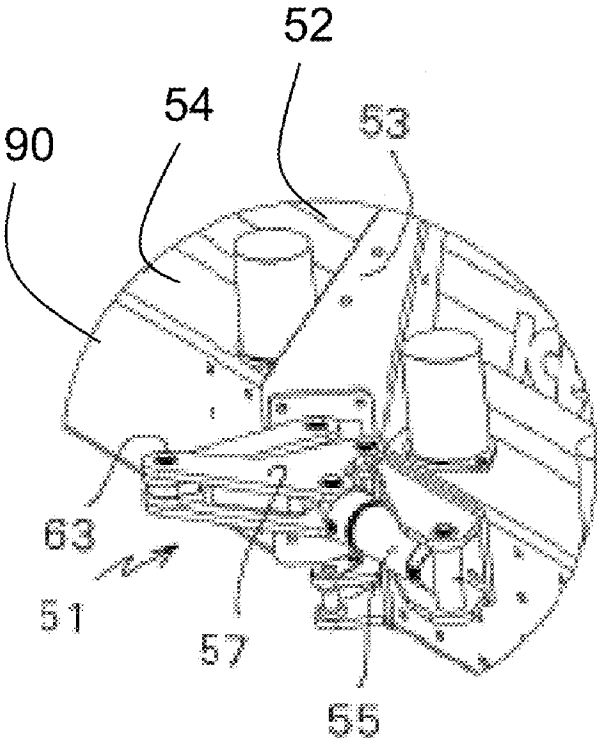
FIG. 5A-B are rear perspective views of the wing blade and hinge in an angled orientation and a straight alignment respectively.
Figure 5A:
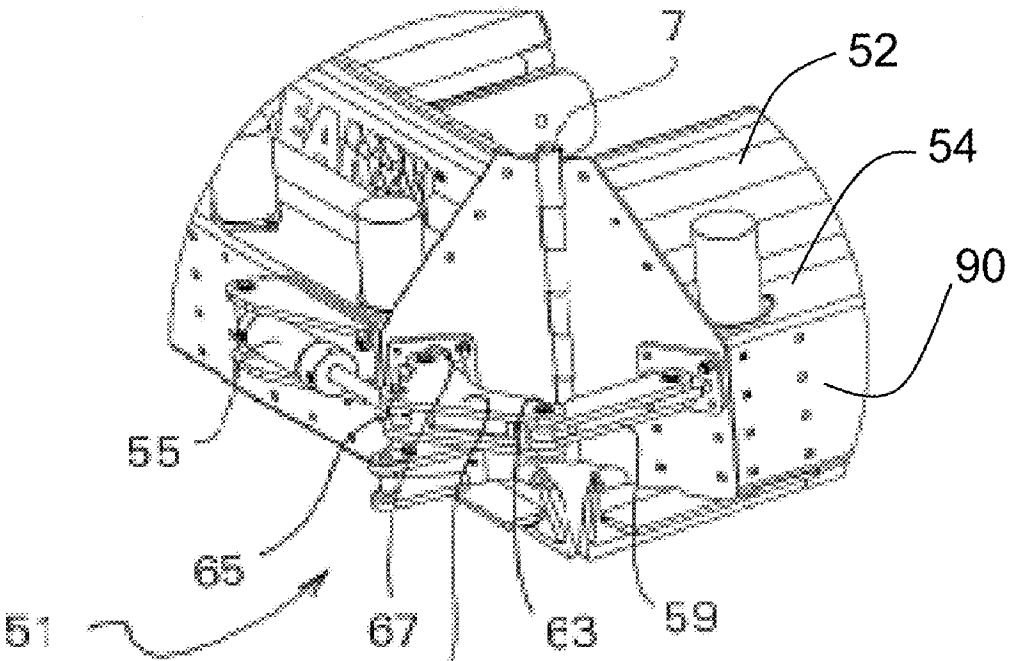
Figure 5C:
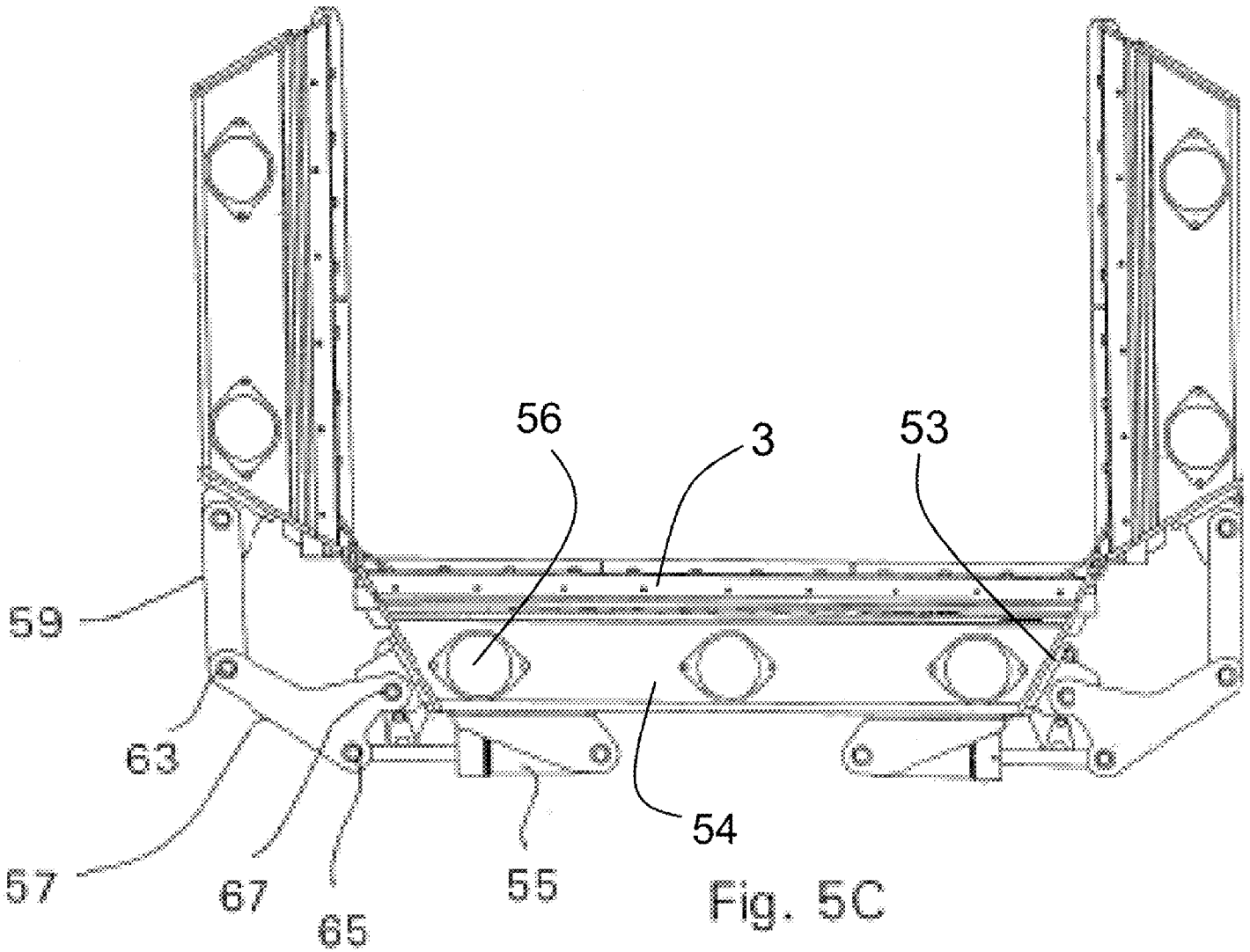
FIG. 5C is a top plan view of the material moving blade in an angled orientation.

Turning to FIGS. 5A-B, the piston 55 is controlled to push against the first pivot point 65 of the first arm 57 thus rotating the first arm 57 about the second pivot point 67 on the main blade 3, forcing the intermediate pivot 63 to extend the second arm 59 and rotate the wing blade 5 about the wing hinge 7. In otherwords, in an extended or angled state of the wing blade 5, as shown in FIGS. 5A and 5C, the piston 55 forces the wing control mechanism 51 to extend from the retracted or folded position and the relative horizontal alignment of the wing and main blades 5, 3 to a desired extended position whereby the wing blade 5 is rotated about the wing hinge 7 relative to the main blade 3 to an angle deemed desirable by the operator.

The respective first and second arms 65, 67 of the wing control mechanism 51 and the respective pivot points, as discussed above, thus facilitate the angulation of the wing blade 5 relative to the main blade 3 about the wing blade hinge(s) 7.

Figure 6:
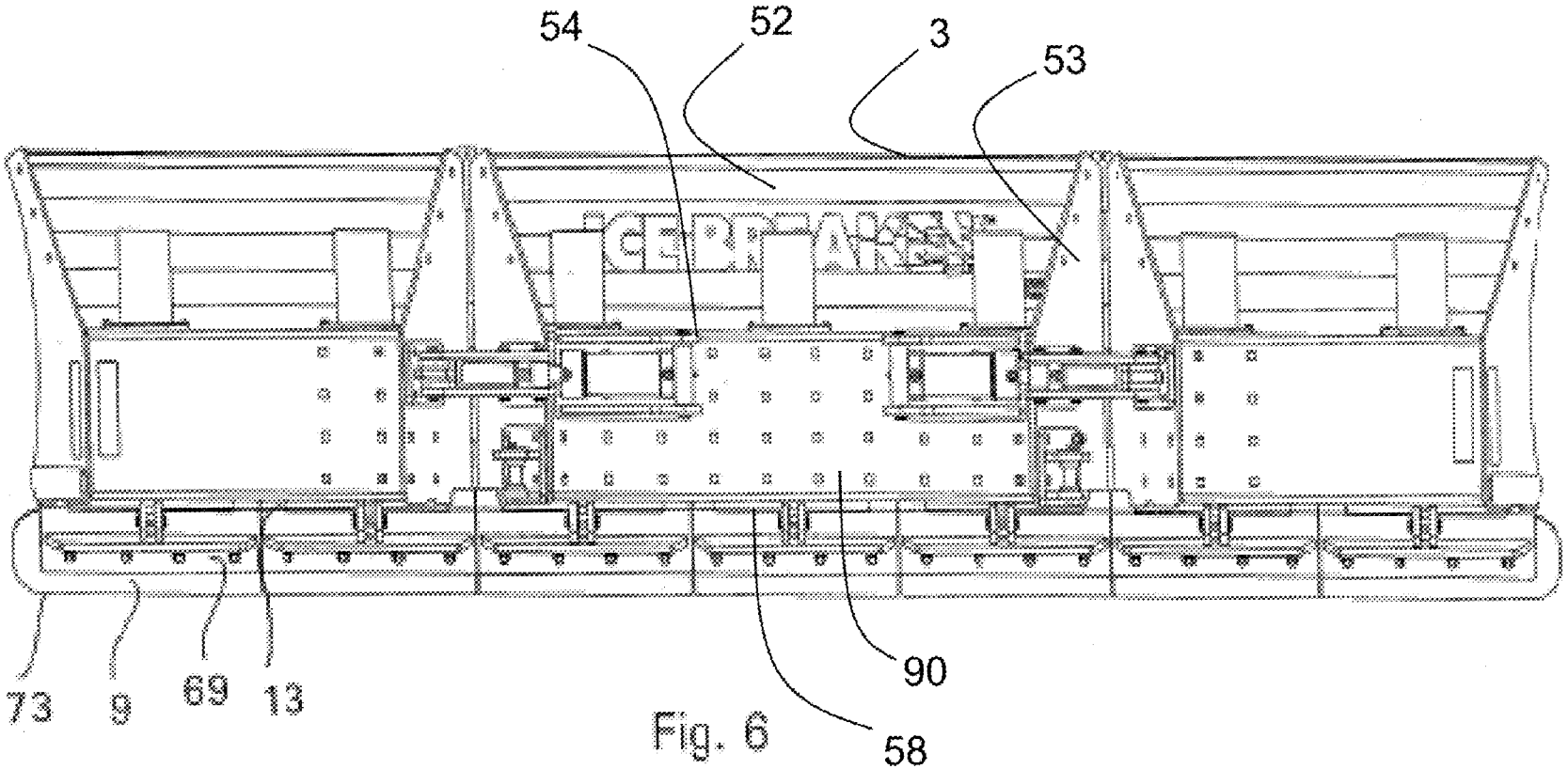
FIG. 6 is a rear elevation view of the materials moving blade and the universal mounting panel.

As originally shown in FIG. 1, the trip blades 9 are supported along the lower edge 8 of both wing blades 5 and the main blade 3 by a substantially horizontal trip hinge(s) 13. At least two trip blades 9 are provided on each of the wing and main blades 5, 3. Observing FIGS. 6 and 7, a further discussion of the trip blades 9 is now provided. For each of the plurality of trip blades 9, a trip blade body 69 is directly hinged to the lower edge 8 of the main blade 3 or wing blades 5 at the hinge 13. The trip blade body 69 is provided with a front face 71 for directly supporting a scraper blade 73, via a bolt and nut fastener, as is well known in the art. Such fasteners facilitate the replacement and repair of the scraper blades 73 should they become worn or damaged. In addition, the trip blade body 69 includes a rearward arranged trip blade pivot 72 for connection with a lever arm 7S extending from the trip blade pivot 72 to a biasing spring 77 supported in a housing 79 on the rear surface of whichever of the main blade 3 and the wing blades 5 is supporting the trip blade 9 itself.

Inside the housing 79, a bottom end of the spring is supported by a support plate 81 on the lever and the spring 77 extends through the housing 79 to an upper end, which abuts against an inner wall of the top 54 of the housing 79. A center shaft 83 extends from a bore connection with the lever 7S upwards through the housing 79 and also through the inside of the spring 77 and out of the housing 79 through a passage 56 in the top 54 of the housing. On an outer wall of the top 54 of the housing, a frictional damping mechanism 85 may be provided, which is critical for the appropriate damped return force of the spring 77 returning the trip blade 9 to its desired alignment with the main or wing blades 3, 5 after an impact. The damping mechanism comprises a frictional gasket 87 having a bore through which the center shaft extends. The bore has a diameter which is the same or smaller than a diameter of the center shaft 83 so that the gasket 87 frictionally engages the outer surface of the center shaft 83 and slows or impedes any axial movement of the center shaft 83 therethrough.

This arrangement of the spring and damping mechanism is important so that in an impact where the trip blade 9 encounters an obstacle, the lever 75 is forced against the spring 77 which is compressed in the housing 79 and the center shaft 83 is forced upwards through the bore of the damping mechanism 85. In this instance, the frictional force of the damping mechanism 85 is merely added to the spring compression force acting on the center shaft 83 and hence on the trip blade 9. Once the trip blade 9 clears the obstacle, the spring, which is now in compression, exerts its return bias on the lever and the trip blade 9. However, in opposition to the return force of the spring 77, the frictional force of the gasket 87 is still applied to the shaft 83 to dampen the returning, downward vertical motion of the shaft 83 and hence the return force of the spring 77 on the trip blade 9. This provides a substantially controlled return of the trip blade 9 to its appropriate alignment with the respective supporting wing or main blade 5,3.

By way of further explanation, when the trip blade 9 encounters an object and is pushed in the direction of the arrow P, a horizontal and vertical force is transferred through the trip blade pivot 72 and the lever arm 75 and compresses the spring 77 forcing the shaft 83 upwards through the housing 79 and the damping mechanism 85. Upon release of the force P, the spring 77 pushes back against the lever 75 and pushes the body 69 and the trip blade 9 itself back into a neutral position relatively aligned with the concave curvature of the Front surface 23 of the main and wing blades 5, 7. The neutral position can be further defined by an adjustable stop 89 secured to the center shaft as seen in FIG. 7, which stops the center shaft 83, and hence the lever 75 and the trip blade body 69 in the desired alignment relative to the front surface 23 of the main blade 3 or wing blade 5.

Figure 7:
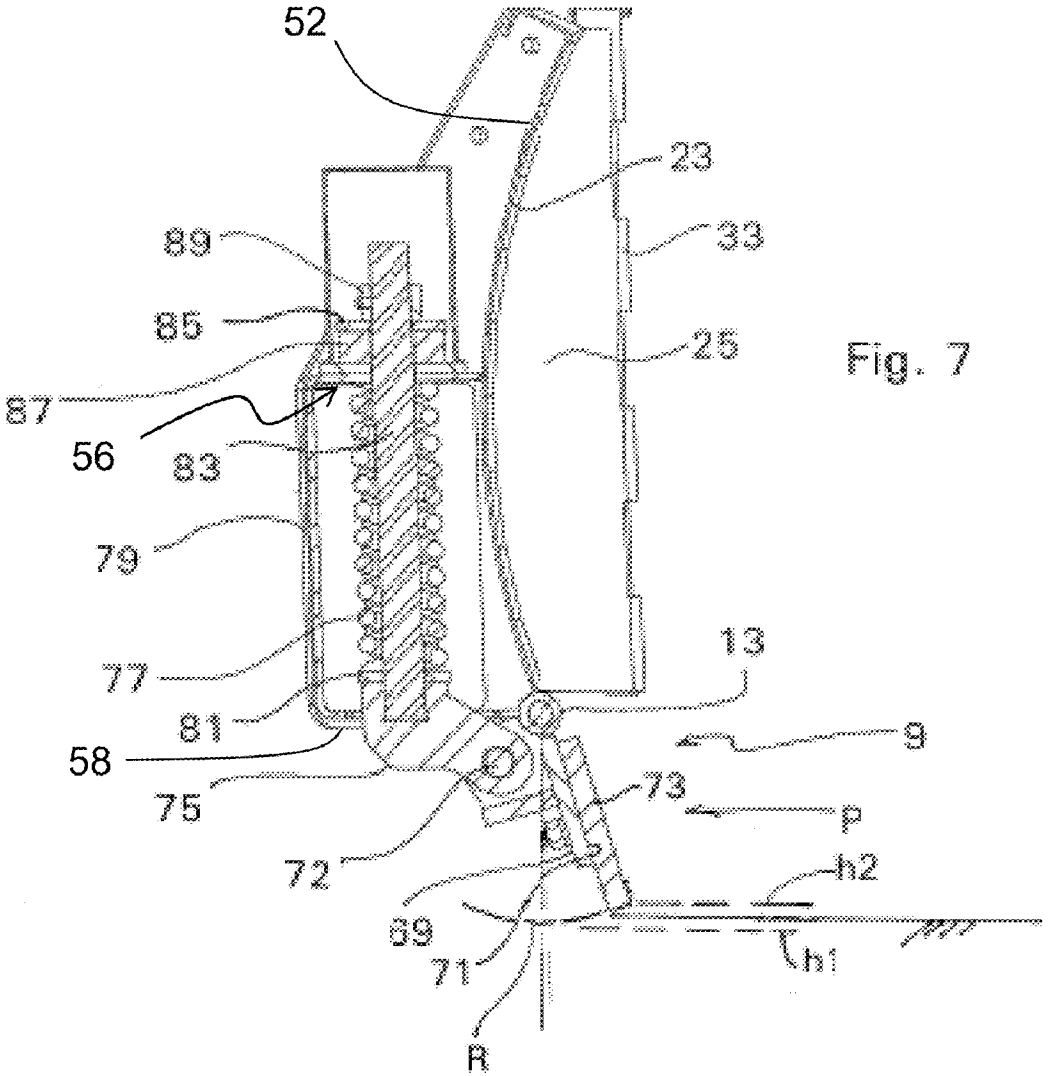
FIG. 7 is a cross-sectional view of the trip blade mechanism and trip blade.

It is also important to note in FIG. 7 that the trip blade 9 itself forms approximately one quarter of the complete height of the materials moving blade. This being the case, the trip hinge 13 is located at a substantial height generally between about 3 and 10 inches above the ground surface upon which the materials moving blade is being operated to provide a substantially higher axis of rotation for the trip blade 9 relative to previously known trip blades. This height also raises the hinge axis 13 above most curbs, road shoulders and berms along a roadway which could damage the hinge 13.

This height is also important because it defines the radius of curvature of the arc through which the trip blade 9 travels. The greater the height of the trip blade 9, the larger, i.e. the flatter, the radius of curvature is in combination with the angle L of the trip blade 9 relative to the vertical. This larger radius of curvature R thus defines a relatively flat arc through which the lower most edge of the trip blade 9 travels about the trip hinge 13 if the trip blade 9 impacts against an object. As can be appreciated from FIG. 7, the trip blade 9, if it strikes an object or the scraper blade 73 strikes an object in the roadway with sufficient force to push the trip blade 9 backwards and along this relatively flat arc, and correspondingly between heights h1 and h2 relative to the roadway. The flat arc and minimal difference between h1 and h2 ensures that there is little to no vertical movement or forces imparted to the containment blade itself.

Such vertical forces imparted to a plow or material containment blade from roadway impacts are a significant problem in the art. These vertical forces can damage both the blade itself as well as the vehicle carrying the materials moving blade. In the prior art where the known shorter trip blades have a smaller and steeper radius of curvature, there is a more significant difference between h1 and h2 as the trip blade 9 swings through a relatively steeper arc, which causes a correspondingly larger vertical force component on the materials moving blade, the mounting system and the carrying vehicle. The reduction of the difference between h1 and h2 provided by the larger height of the present scraper blade can thus decrease the vertical forces and any "bounce" of the blade and vehicle upon impact with an obstruction in the roadway.

Figure 8A:
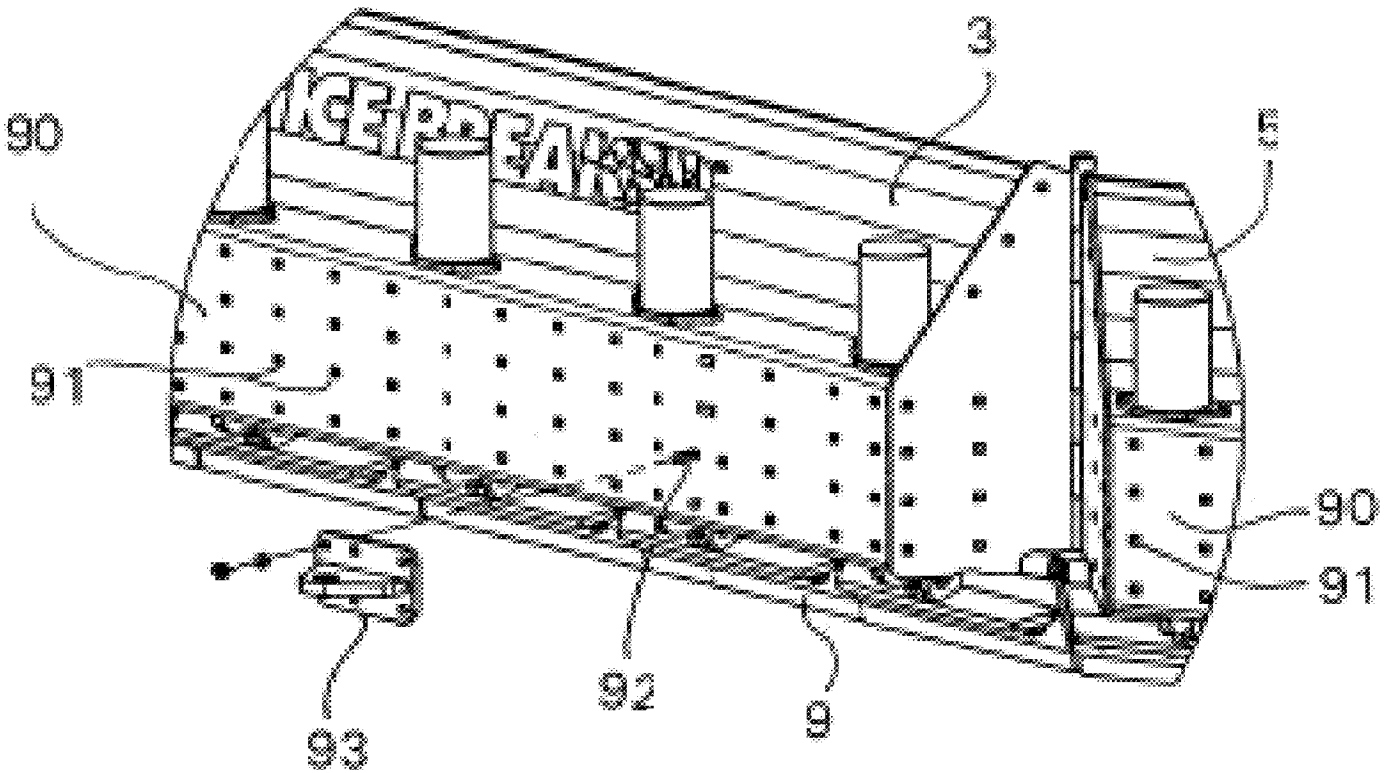
FIGS. 8A-B are an exploded view of different mounting lugs corresponding to the array of holes in the universal support panel.
Figure 8B:
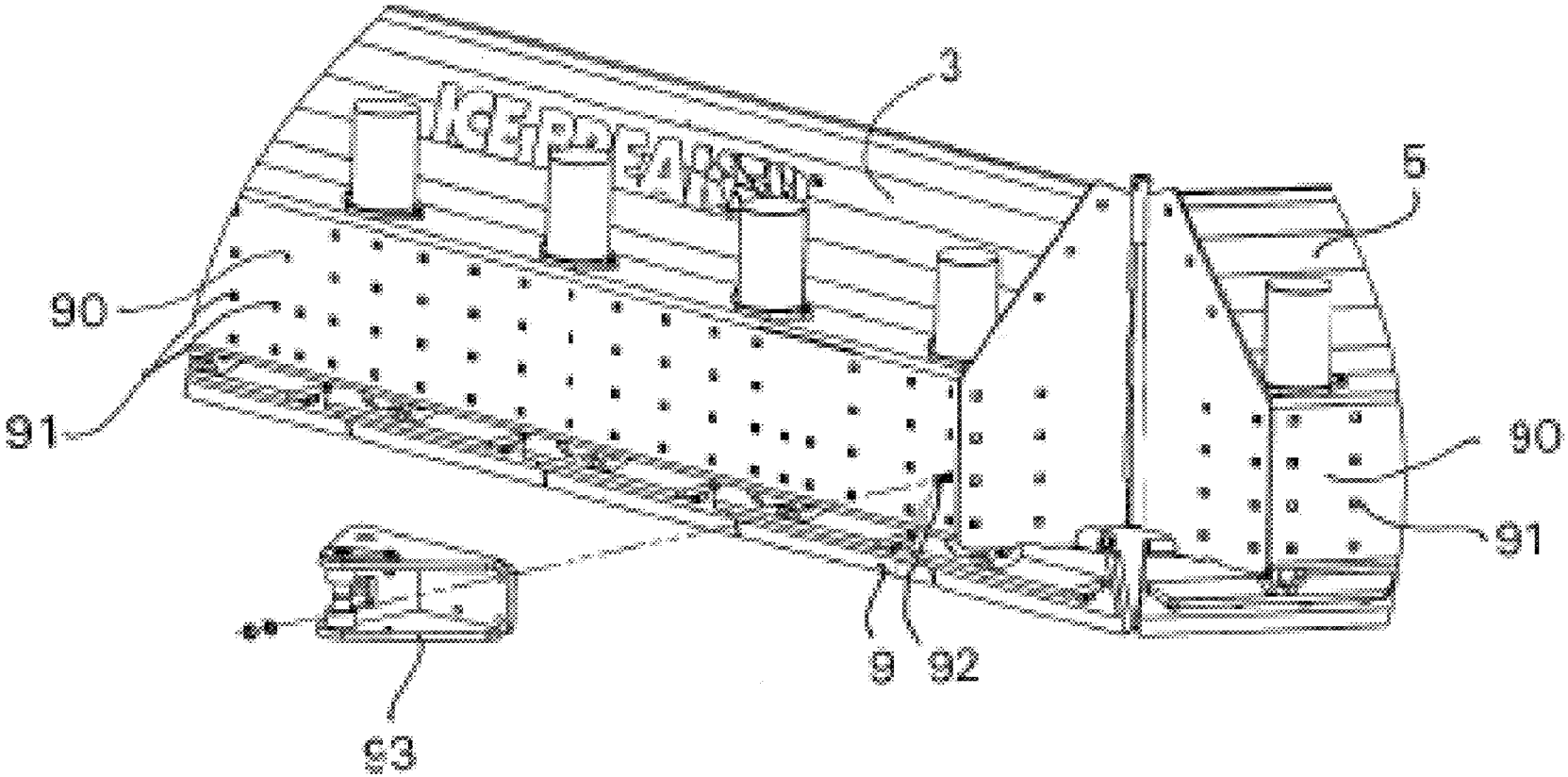

Turning to FIGS. 8A-D, another important aspect of the present invention is a universal mounting panel 90 positioned on the back portion of the materials moving blade 1. The universal mounting panel 90 as seen in FIG. 8A can be arranged on the back 52 of each of the wing blades 5 as well as on the back 52 of the center main blade 3. The universal mounting panel 90 is initially part of a protective enclosure to ensure that the trip springs and at least part of the mechanism for controlling the trip blade 9 are substantially protected from the environment including road debris, snow, dirt, etc. In a preferred embodiment of the invention the universal mounting panel 90 is provided with an array of perforations, i.e. a plurality of holes 91 which are formed through the mounting panel 90. These holes 91 define a significant number of variable mounting points and arrangements for mounting hardware and actuating mechanisms to couple, support and manipulate the materials moving blade 1 relative to a carrying vehicle.

Each of the mounting panels 90, on either or both of the main blade 3 or wing blade 5 as shown, is substantially parallel aligned with the front main blade 3, although it need not be provided with a corresponding curvature as the front main blade 3. The mounting panel 90 is also provided with the array of holes 91 directly facing the supporting mechanism extending from the carrying vehicle. In a preferred embodiment, the array is made up of rows and columns including a plurality of square holes 91 which are arranged substantially the same distance from one another throughout the array. Such holes 91 could also be circular or any other shape, and also spaced at varying, or any desired distances from one another for that matter.

For purposes of the present description and for describing the use of these holes 91 with a carriage bolt 92 and a corresponding mounting lug 93, the holes 91 are described herein as square. With such square holes 91 a carriage bolt 92 can thus be inserted directly into such hole 91 from within a space between the main blade and the panel 90, and when fully inserted therein and extending rearward through the associated hole 91 in the panel 90, a square buttress located beneath the head of the carriage bolt 92 will snugly and securely fit within the matching square edges forming the hole 91 and thereby be maintained from turning relative to the hole 91. As seen by the differences between FIGS. 8A and 8B, The array of holes 91 provides a variety of different positions to which a desired mounting lug 93 can be readily connected to accommodate different mounting equipment geometries and vehicles.

Figure 8C:
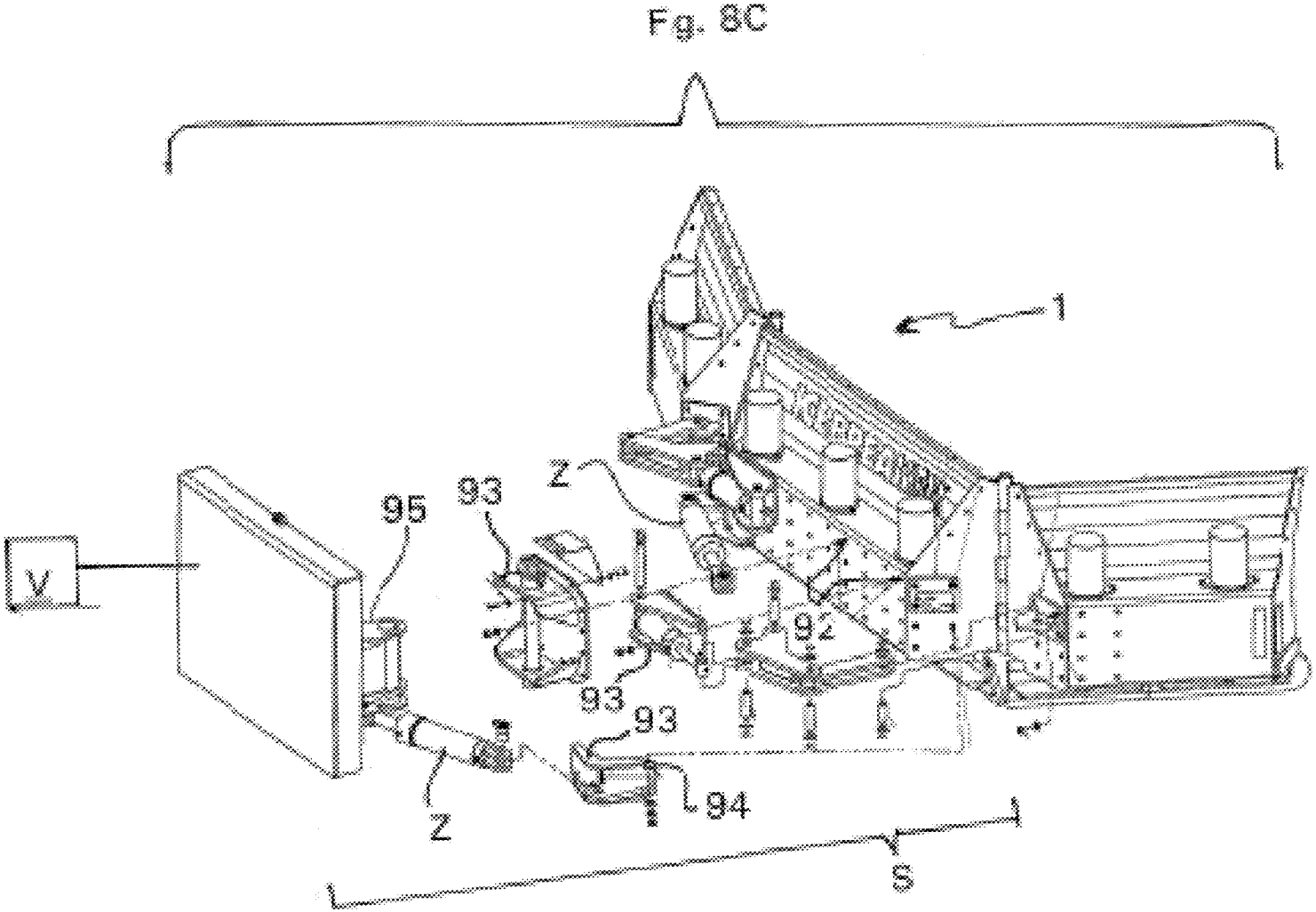
FIGS. 8C-D are an exploded and unexploded views respectively of the main blade, universal support panel and blade supporting apparatus.
Figure 8D:
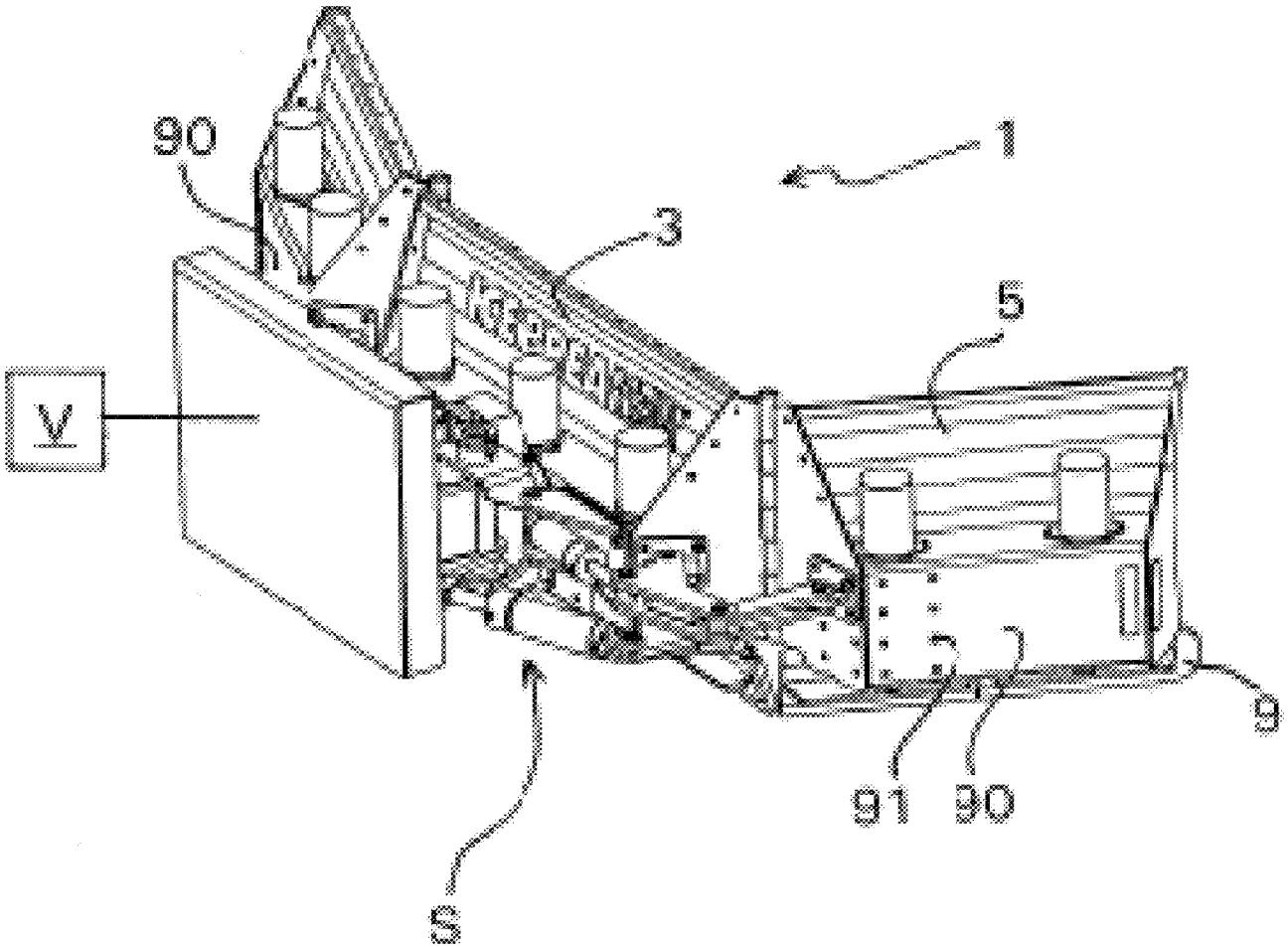

As shown diagrammatically in FIG. 8C-D, a materials moving blade1 is attached to a carrying vehicle V via a support structure S comprising at least a mounting arm 95, or a pair of mounting arms extending from a connection with the front end of a carrying vehicle V. The support structure S not only supports the moving blade 1, but also usually provides for variable positioning of the blade 1 via a number of hydraulic actuators Z which can angle, as well as potentially vertically and horizontally reposition the materials moving blade 1 as known in the art. These support structures S are available in many different configurations and geometries throughout the industry depending on the type and manufacture of vehicle V. Because of these differences in support structures S mounting lugs 93 and relative geometries of such mounting arms 95, it is very difficult to design a materials moving blade 1 which can be universally connected with such a variety of support structures S. Thus, as previously discussed in the Background of the Invention, it is quite common in the industry to undertake a particular custom welding operation on each blade to configure that blade for any particular carrying vehicle and support structure.

With the present invention and the universal mounting panel 90 as described above, the issue of custom welding a materials moving blade 1 is eliminated since there are a multitude of positional arrangements within the defined array of holes 91 which will accommodate different geometries and support systems S. In order to attach the materials moving blade 1 to a particular support structure S and the corresponding mounting arm 95, it is a relatively simple matter to produce the corresponding intermediate mounting lug or lugs 93 which includes a plurality of matching bolt receiving holes 94 corresponding to a portion of the array of holes 91 on the mounting plate 90 so that the mounting lug(s) 93 can be easily mounted at any point within the array of holes 91 on the universal mounting plate 90.

The intermediate mounting lug 93 can be of any particular desired construction, but is in each case constructed having a series of bolt receiving holes 94 for the carriage bolts 92 extending through the holes 91 in the universal mounting panel 90. The mounting lug 93 is positioned within the array of holes 91 at an appropriate position to connect with the specific support structure attached to the vehicle V. The carriage bolts 92 are inserted from within the enclosure i.e. from within a space 99 defined at least partly between the universal mounting panel 90 and the front panel of the main blade so that the carriage bolts 92 extend out through the universal panel 90 and engage the square holes 91 so as to be maintained from rotating relative thereto. With the threaded end on the carriage bolt 92 extending rearwardly through the universal mounting panel 90, the intermediate mounting lug 93 is engaged by the carriage bolts 92. It can thus be appreciated that the intermediate mounting lugs 93 may be arranged in almost any configuration within the array of holes 91 on the universal mounting panel 90. Thus, the appropriate intermediate mounting lug 93 can be moved to different locations on the back of either the main blade 3 and/or the wing blades 5 in order to accommodate any particular geometry of support system S, or mounting arm 95 utilized with any particular vehicle V.

The above described aspects of the present invention is important for it allows the use of a commonly manufactured material moving blade 1 and even foldable wing blades 5 to be used with almost any particular type of vehicle V and support system geometry. It is much easier to fabricate a unique or custom intermediate mounting lug 93 for any particular type of support system S and mounting arm 95 geometry than it is to fit up i.e. weld and manufacture a complete new attachment mechanism for the blade 1. Thus, the manufacturer can fabricate and stock the same materials moving blade 1 while needing only to fabricate and stock a variety of intermediate mounting lugs to accommodate any mounting system geometry and vehicle. It is to be appreciated that the mounting lugs 93 may comprise several different parts or pieces which then may be secured in the above described manner to the universal mounting panel 90 is seen in FIG. 8D within an appropriate position in the array of holes 91.

This structure also enables an end user to easily adjust the mounting points and/or easily completely change the mounting lug 93 to accommodate a different vehicle and support geometry using the materials moving blade 1. In the case of changing to a different vehicle, there is no need to re-weld or provide a new welded fit up on the materials moving blade 1 but merely to move the appropriate intermediate mounting lug 93 to a different position in the array of holes 91. In the worst case, where a different vehicle will support the blade 1, only a new intermediate lug 93 need be ordered or fabricated by the end user to accommodate a different support system S. This new intermediate lug can be easily mounted by the end user within the array on either of the main blade 3 and/or the wing blades 5.

Observing FIG. 4, it is important to note that access to the space, or interior of the area protected by the universal mounting panel 90 is attained via access ports 97 in a bottom portion of the protective enclosure. These access ports 97 shown here in a bottom panel 58 of the enclosure allow a user to insert their hand along with the carriage bolt 92 inside the enclosure with sufficient access to insert the carriage bolt 92 through the mounting panel 90 and connect with the intermediate mounting lug 93 in any desired location within the array of holes 91.

Since certain changes may be made in the above described improved materials moving blade 1 without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A materials moving blade (1) comprising:

a main blade (3) having;

a materials engaging panel bounded by a first end, a second end, a top edge (6) and a lower edge (8) having a hinge axis;

a plurality of spring biased trip blades (9) supported by the hinge axis along the lower edge (8) of the materials engaging panel, each trip blade (9) supporting a cutting blade;

a rear mounted enclosure comprising an array of holes for receiving a connection to a separate materials moving blade support structure and the rear mounted enclosure is directly connected to the main blade and in conjunction therewith defines a substantially enclosed space in which a plurality of springs are housed for biasing the plurality of trip blades;

the rear mounted enclosure comprises a top plate and a bottom plate connected along an entire front edge of each of the top and bottom plates to the main blade, a rear panel is spaced from the main blade and supported along an entire back edge of each of the top and bottom plates, a pair of opposing side plates are connected along an entire side edge of each of the top and bottom plates and also connected along an entire respective side edges of the rear panel to define the enclosed space and partially enclose the plurality of springs;

a plurality of upper passageways are provided in the top plate of the rear mounted enclosure for permitting an upper portion of each of the plurality of springs to extend therethrough and each of the plurality of passageways is covered by a top cover attached to the top plate of the rear mounted enclosure to entirely enclose the upper portion of each of the plurality of springs; and wherein a plurality of lower passageways are formed in the bottom plate to permit an operator access to an inner side of the rear panel to facilitate the connection of the rear panel to a support structure via the away of holes in the rear mounted enclosure.

2. The materials moving blade (1) as set forth in claim 1, wherein at least one of the first and second ends of the main blade hingedly supports a wing blade movable relative to the main blade.

3. The materials moving blade (1) as set forth in claim 2, wherein the wing blade is also provided with a lower edge having a hinge axis blade supporting a plurality of spring biased trip blades.

4. The materials moving blade (1) as set forth in claim 3, wherein the rear mounted panel is substantially parallel aligned with the front materials engaging surface.

5. The materials moving blade (1) as set forth in claim 4, wherein the array of holes is defined by a plurality of rows and a plurality of columns, each row and column comprising a plurality of holes.

6. The materials moving blade (1) as set forth in claim 5, further comprising a second array of holes formed on a respective second rear mounted panel supported on the wing blade.

7. The materials moving blade (1) as set forth in claim 1 wherein a separate mounting lug is provided with a plurality of connection points matching a desired combination of the plurality holes.

8. The materials moving blade (1) as set forth in claim 1 wherein the plurality of holes in the rear mounted panel are arranged in an away comprising a series of rows and columns.

9. The materials moving blade (1) as set forth in claim 8 wherein the rows of holes are substantially equally spaced apart and the columns of holes are also equally spaced apart to facilitate connection of a support article in alternative positions throughout the array.

* * * * *